US008316967B2

(12) United States Patent
Gavia

(10) Patent No.: US 8,316,967 B2
(45) Date of Patent: Nov. 27, 2012

(54) EARTH-BORING TOOLS WITH PRIMARY AND SECONDARY BLADES, METHODS OF FORMING AND DESIGNING SUCH EARTH-BORING TOOLS

(75) Inventor: David Gavia, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 360 days.

(21) Appl. No.: 12/265,526

(22) Filed: Nov. 5, 2008

(65) Prior Publication Data

US 2009/0114453 A1 May 7, 2009

Related U.S. Application Data

(60) Provisional application No. 60/985,331, filed on Nov. 5, 2007.

(51) Int. Cl.
*E21B 10/00* (2006.01)

(52) U.S. Cl. ..... 175/327

(58) Field of Classification Search ..... 175/327, 175/398

See application file for complete search history.

(56) References Cited

U.S. PATENT DOCUMENTS

2006/0070771 A1* 4/2006 McClain et al. ..... 175/57
2007/0078632 A1* 4/2007 Shen et al. ..... 703/1
2007/0106487 A1 5/2007 Gavia et al.
2007/0240905 A1 10/2007 Mensa-Wilmot
2007/0261890 A1* 11/2007 Cisneros ..... 175/331

FOREIGN PATENT DOCUMENTS

GB 2428840 A 2/2007

OTHER PUBLICATIONS

Glowka, D.A., "Use of Single-Cutter Data in the Analysis of PDC Bit Designs: Part 2—Development and Use of the PCDWEAR Computer Code," J. Petroleum Tech., 850, SPE Paper No. 19309 (Aug. 1989).

PCT International Search Report for International Application No. PCT/US2008/082404, mailed Feb. 25, 2009.

* cited by examiner

*Primary Examiner* — Shane Bomar
*Assistant Examiner* — Sean Andrish
(74) *Attorney, Agent, or Firm* — TraskBritt

(57) ABSTRACT

Earth-boring tools comprise a body including a face at a leading end thereof and a shank at a trailing end. At least one primary blade may extend radially outward over the face and may comprise a plurality of cutting elements disposed thereon. At least one secondary blade may also extend radially outward over a portion of the face and the at least one secondary blade may comprise a plurality of cutting elements disposed thereon only over at least a portion of an area of greatest work rate per cutting element. Methods of forming earth-boring tools and methods of designing earth-boring tools are also disclosed.

17 Claims, 4 Drawing Sheets

EARTH-BORING TOOLS WITH PRIMARY AND SECONDARY BLADES, METHODS OF FORMING AND DESIGNING SUCH EARTH-BORING TOOLS

CROSS-REFERENCE TO RELATED APPLICATION

The present application claims the benefit of U.S. Provisional Patent Application Ser. No. 60/985,331, filed Nov. 5, 2007, the disclosure of which is incorporated herein by reference in its entirety.

TECHNICAL FIELD

The present invention relates generally to earth-boring tools and, more particularly, to blade configurations and cutting element configurations for earth-boring tools.

BACKGROUND

Rotary drill bits are commonly used for drilling bore holes or wells in earth formations. One type of rotary drill bit is the fixed-cutter bit (often referred to as a "drag" bit), which typically includes a plurality of cutting elements secured to a face region of a bit body. Referring to FIG. 1, a conventional fixed-cutter earth-boring rotary drill bit 100 includes a bit body 110 having generally radially projecting and longitudinally extending wings or blades 120 over the bit face 130 thereof and a plurality of cutting elements 140 are generally disposed thereon.

The blades 120 are typically characterized into three categories: primary blades 120', secondary blades 120" and tertiary blades (not shown). The primary blades 120' are those that, conventionally, extend radially closest to the center of the bit body 110. The plurality of cutting elements 140 disposed on the primary blades 120', generally encompass, in combination, the entire bit face cutting profile from near the center of the bit body 110 to the shoulder/gage regions. The secondary blades 120" (and tertiary, when present); conventionally begin radially further away from the center of the bit body 110 and extend into the shoulder area. FIG. 2 shows a schematic side cross-sectional view of a conventional cutting element placement design along a face profile of a conventional drill bit. As can be seen, cutting elements 140' (depicted as solid ovals and truncated ovals) are conventionally placed along the primary blades 120' (see FIG. 1) to extend from the cone region 150 to the shoulder region 170. The cutting elements 140" on the secondary and/or tertiary blades (depicted as dashed-lined ovals and truncated ovals) conventionally extend from the nose region 160 to the shoulder region 170.

BRIEF SUMMARY

Various embodiments of the present invention comprise earth-boring tools. In one or more embodiments, the earth-boring tool may comprise a body comprising a face at a leading end thereof and a shank at an opposing trailing end. The face may comprise at least one primary blade extending radially outward thereover. The at least one primary blade may comprise a plurality of cutting elements disposed thereon. The face may further comprise one or more secondary blades extending radially outward over a portion thereof. The one or more secondary blades may comprise a plurality of cutting elements disposed thereon only over at least a portion of an area of greatest work rate per cutting element. In some embodiments, the plurality of cutting elements on the one or more secondary blades may be disposed over a portion only within at least one of a cone region and a nose region of the face.

Other embodiments comprise methods of forming an earth-boring tool. One or more embodiments of such methods may comprise forming a body comprising a face at a leading end thereof and a shank at a trailing end thereof. At least one primary blade may be formed extending radially outward over the face. The at least one primary blade may comprise a plurality of cutting elements disposed thereon. One or more secondary blades may also be formed to extend over a portion of the face. The one or more secondary blades may comprise a plurality of cutting elements disposed thereon and positioned substantially over an area of greatest work rate per cutting element.

In still other embodiments, the invention comprises methods of designing an earth-boring tool. One or more embodiments of such methods may comprise providing a body comprising at least one primary blade extending radially outward over a face thereof. An area of greatest work rate per cutting element may be determined for the body and at least one secondary blade may be positioned on the face to extend over at least the area of greatest work rate per cutting element. A position for a plurality of cutting elements may be selected on the at least one secondary blade, which position may be located only within the area of greatest work rate per cutting element.

DETAILED DESCRIPTION

The illustrations presented herein are, in some instances, not actual views of any particular earth-boring tool or drill bit, but are merely idealized representations which are employed to describe the present invention. Additionally, elements common between figures may retain the same numerical designation.

Figure 1:
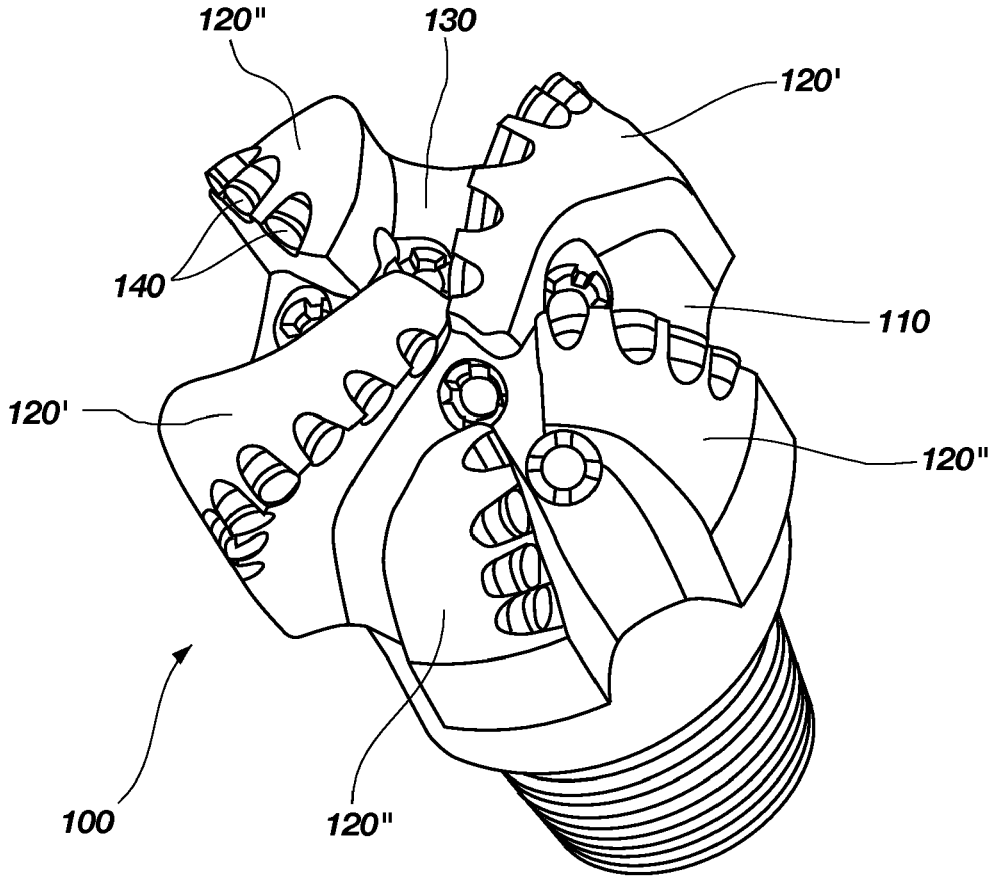
FIG. 1 (PRIOR ART)
FIG. 1 illustrates an isometric view of a prior art drill bit.
Figure 2:
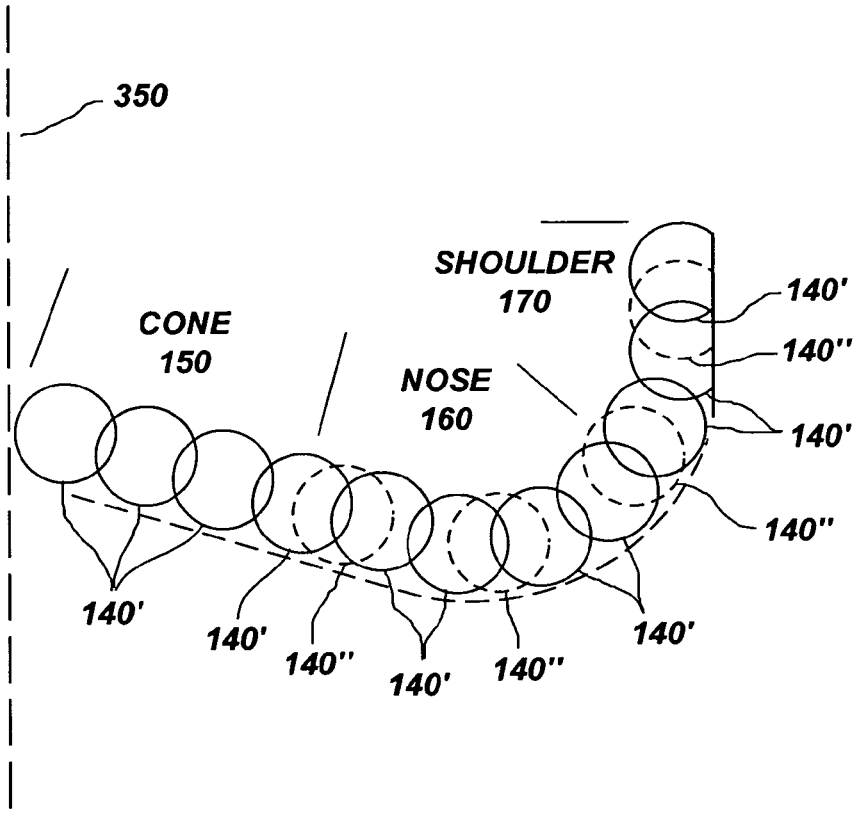
FIG. 2 (PRIOR ART)
FIG. 2 illustrates a schematic side cross-sectional view of a prior art cutting element placement design along a face profile of a conventional drill bit.
Figure 3:
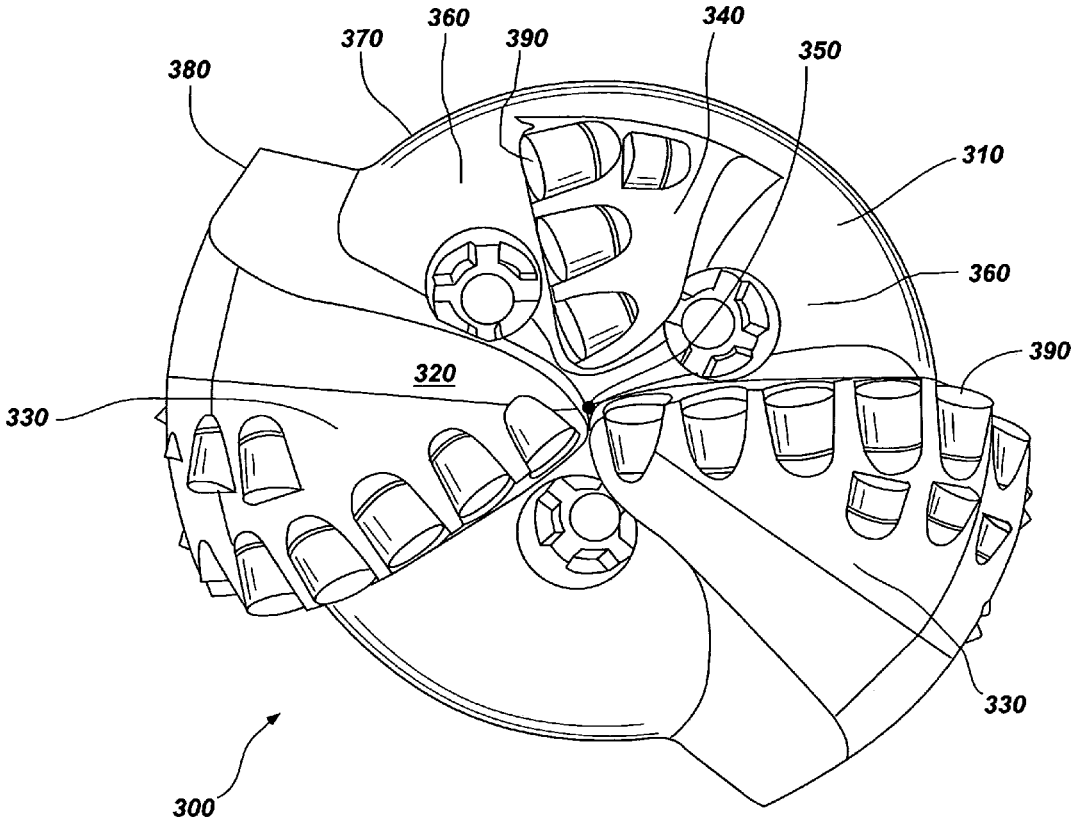
FIG. 3 illustrates a plan, or face, view of a fixed-cutter or so-called "drag" bit face according to at least one embodiment of the present invention.

Various embodiments of the present invention are directed toward embodiments of an earth-boring tool comprising one or more secondary blades positioned substantially in a location of greatest work rate per cutting element. FIG. 3 illustrates a plan, or face, view of an earth-boring tool face according to some embodiments of the present invention configured as a fixed-cutter drill bit. Drill bit 300 includes a bit body 310 having a face 320 at a leading end thereof and generally radially extending blades, comprised of one or more primary blades 330 and one or more secondary blades 340, disposed about a centerline or longitudinal axis 350. The bit body 310 may comprise a metal or metal alloy, such as steel, as well as a particle-matrix composite material, as are known generally to those of ordinary skill in the art. Fluid courses 360 are formed between primary blades 330, as well as between primary blades 330 and secondary blades 340, extending to junk slots 370. Longitudinally opposite the face 320, at a trailing end of the drill bit 300, is a structure (not shown) comprising a threaded shank for connecting the earth-boring tool to a drill string (not shown).

The drill bit 300 may comprise at least one primary blade 330 and at least one secondary blade 340. The at least one primary blade 330 may extend into a shoulder 170 (FIG. 4), adjacent a gage region 380 configured to define the outermost radius of the drill bit 300 and, thus, the radius of the wall surface of a bore hole drilled thereby. Gage regions 380 comprise longitudinally upward (as the drill bit 300 is oriented during use) extensions of primary blades 330 and may carry cutting elements with linear cutting edges oriented parallel to the longitudinal axis 350 to cut the gage diameter, as well as wear-resistant inserts formed of tungsten carbide (WC) or coatings, such as hardfacing material, on radially outer surfaces thereof as known in the art to inhibit excessive wear thereto.

Drill bit 300 is provided with a plurality of cutting elements 140', 140" on both the one or more primary blades 330 and the one or more secondary blades 340. Generally, the cutting elements 140', 140" may have either a disk shape or, in some instances, a more elongated, substantially cylindrical shape. The cutting elements 140', 140", may comprise a "table" of super-abrasive material, such as mutually bound particles of polycrystalline diamond, formed on a supporting substrate of a hard material, conventionally cemented tungsten carbide, as is known in the art. Such cutting elements are often referred to as "polycrystalline diamond compact" (PDC) cutting elements or cutters. The plurality of PDC cutting elements 140', 140" may be provided within cutting element pockets formed in rotationally leading surfaces of each of the primary and secondary blades 330, 340, respectively. Conventionally, a bonding material such as an adhesive or, more typically, a braze alloy may be used to secure the cutting elements 140', 140" to the bit body 310. Rotary drag bits employing PDC cutting elements have been employed for several decades.

Figure 4:
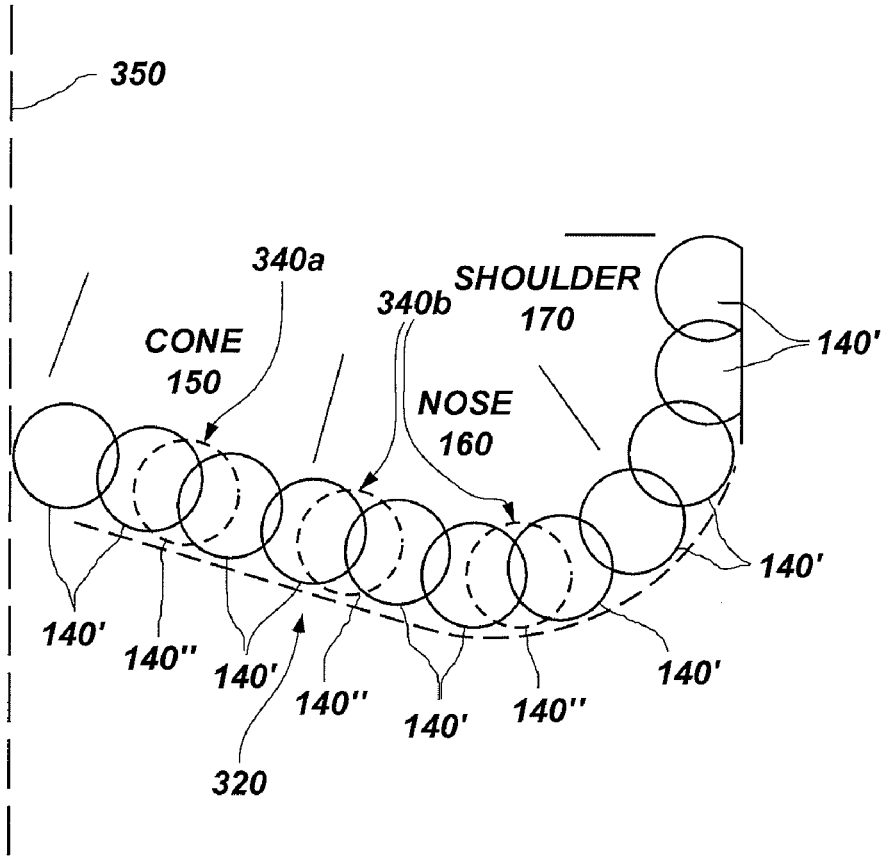
FIG. 4 depicts a profile view of a cutting element coverage of a drill bit according to at least one embodiment of the present invention.

Referring to FIG. 4, a schematic side cross-sectional view of a cutting element placement design of a drill bit is shown according to at least some embodiments of the present invention. As illustrated in FIG. 4, the face 320 includes a cone region 150, a nose region 160, and a shoulder 170. As noted above, longitudinal axis 350 extends longitudinally through the center of the drill bit 300, through the center of face 320 and the center of the shank (not shown). The view illustrated in FIG. 4 shows locations of cutting elements 140', 140" of the one or more primary blades 330 and the one or more secondary blades 340 of a drill bit, such as the drill bit 300 of FIG. 3, rotated about longitudinal axis 350 and on a single side of the profile of the bit. The solid-lined ovals and truncated ovals (representing back raked cutting elements, as is conventional) comprise cutting elements 140' arrayed over at least one primary blade 330, shown in superimposition as the cutting elements 140' would sweep over the face of a formation during drilling as the drill bit 300 is rotated. As illustrated, the cutting elements 140' disposed on the one or more primary blades 330 may extend from a location in the cone region 150 near or adjacent the longitudinal axis 350 radially outward to and over the shoulder 170. As described above, because one or more primary blades 330 extend longitudinally upward beyond the shoulder 170, the one or more primary blades 330 comprise the gage regions 380.

The cutting elements 140" disposed over the at least one secondary blade 340 are illustrated as broken-lined ovals. Placement of the at least one secondary blade 340 or the placement of the cutting elements 140" over the at least one secondary blade 340, or both, may be determined according to that area of highest work-force rate (also referred to herein as "work rate") per cutting element. Unlike secondary blades in conventional bits, wherein such blades have cutting elements disposed from a location fairly remote from the longitudinal axis 350 of the drill bit 300 and extending into the shoulder region 170, the cutting elements 140" disposed over the at least one secondary blade 340 of drill bit 300 may extend over a location of the drill bit 300 where the highest work per cutting element occurs, which may include locations near or adjacent to the longitudinal axis 350, as well as fairly remote therefrom.

"Work rate" is a calculation of the force on the cutting elements and the distance over which that force is applied, and may be normalized against a benchmark, which may include distance drilled or rate-of-penetration, among others. The amount of work done by each cutting element 140', 140" per revolution of an earth-boring bit or other drilling tool may be dependent on the radial position of the cutting element 140', 140" (i.e., the radial distance from the longitudinal axis 350). Generally, the cutting elements 140', 140" that see the most cutter load (i.e., that remove the most amount of material per unit volume) for a given cutting exposure above the face 320 of the drill bit 300 or other tool are the cutting elements 140', 140" located toward the center of the face 320, in the cone and nose regions 150, 160, respectively. This is because such cutting elements travel a steeper helical path, as the drill bit 300 rotates and moves longitudinally into a formation, than cutting elements farther from the centerline of the bit.

Furthermore, cutting elements 140', 140" within the nose region 160 radially adjacent the cone region 150, often wear at a faster rate, as weight on-bit (WOB) is supported to a great extent in this face region of the bit or drilling tool, and on the few cutting elements located in these regions. Unlike in the shoulder region 170, there is little or no cutter redundancy in the cone region 150, and little redundancy in the nose region 160, due to space and hydraulic constraints presented by the limited available surface area on the bit or other drilling tool face. As a bit or other earth-boring tool progresses through subterranean formations, the cutting elements begin to wear at an accelerated rate, forming a so-called "wear flat" on the side of the cutting element diamond table and supporting substrate that is in contact with the subterranean formation. These wear flats, by increasing the surface area of the cutting elements in contact with the formation, reduce the amount of work being done as the load per unit area on the cutting elements is reduced and the rate-of-penetration (ROP) of the bit or other drilling tool decreases.

By placing cutting elements 140" in the regions of greatest work rate per cutting element over the cutter profile and omitting cutting elements in those areas of the drill bit 300 with lesser per cutting element work rate, the bit or other drilling tool according to embodiments of the invention exhibits an increased rate-of-penetration in comparison to conventional bits and drilling tools. Additionally, without the cutting elements in areas of lesser work rate, there are fewer cutting elements that will form wear flats, thus reducing the combined surface area of all the cutting elements and maintaining a high load per unit surface area on the cutting elements, enabling a better rate-of-penetration over a longer period of time.

Therefore, by way of example and not limitation, in the embodiments illustrated in FIG. 4, the work rate may be determined to be generally highest for those cutting elements in the cutter profile disposed in the cone region 150 and the nose region 160, due to a lack of cutting element redundancy in those regions, and generally lower for those cutting elements disposed in the shoulder region 170. Thus, as illustrated in FIG. 4, the cutting elements 140" disposed over the at least one secondary blade 340 (FIG. 3) may extend radially from a position within the cone region 150 to a location within the nose region 160. In some embodiments, the at least one secondary blade 340 may extend slightly into the shoulder region 170, while the cutting elements 140" disposed thereon extend from a location within the cone region 150 to a location still within the nose region 160. In other embodiments, the cutting elements 140" disposed over the at least one secondary blade 340 may extend from a location within the cone region 150 to a location proximate the radially inner portion of the shoulder 170. In still other embodiments, the cutting elements 140" disposed over the at least one secondary blade 340 may extend from a location within the cone region 150 adjacent to the longitudinal axis 350 at least to the nose region 160.

It has been shown that by positioning the cutting elements 140" on the at least one secondary blade 340 placed in those regions of greatest work rate per cutting element, which in FIG. 4 comprises a location from within the cone region 150 to a location within the nose region 160 and not in those areas with lesser per cutting element work rate, comprising the shoulder region 170 in FIG. 4, the earth-boring tool exhibits a greater rate-of-penetration over the life of the tool and a substantially reduced wear flat growth when compared with generally conventional earth-boring tools.

In some embodiments of the invention, the drill bit 300 may comprise a plurality of secondary blades 340 extending radially from at least the cone region 150 to at least the nose region 160. In at least some of these embodiments, at least one of the secondary blades 340*a* may comprise at least one cutting element 140" disposed only within a portion of a region of greatest work rate per cutting element, and at least one other secondary blade 340*b* may comprise at least one cutting element 140" disposed only within another portion of the region of greatest work rate per cutting element. By way of example and not limitation, in at least some of these embodiments in which the region of greatest work rate generally comprises the cone region 150 and the nose region 160, as shown in FIG. 4, at least one of the secondary blades 340*a* may comprise at least one cutting element 140" disposed over a portion thereof only within the cone region 150. Further, at least one other secondary blade 340*b* may comprise at least one cutting element 140" disposed over a portion thereof only within the nose region 160.

Although FIGS. 3 and 4 illustrate an earth-boring tool having a work rate which is highest over the cone region 150 and the nose region 160, as described above, other embodiments of the present invention may include earth-boring tools having differing work rate distributions over the face. In these embodiments, the placement of the cutting elements 140', 140" disposed over the plurality of secondary blades 340 may be configured to extend across that region or those regions of greatest work rate. By way of a non-limiting example, if the area of highest work rate corresponds solely with the nose region 160, the at least one secondary blade 340 may be configured to comprise cutting elements 140" disposed over just the nose region 160. With the cutting elements 140" disposed over just the nose region 160, the at least one secondary blade 340 may be configured to extend over just the nose region 160. However, the at least one secondary blade 340 may extend from well within the cone region 150 to well within the shoulder region 170, so long as the cutting elements 140" are disposed primarily over the nose region 160. Other configurations are also possible according to the specific implementation and design of an earth-boring tool.

Additional embodiments of the present invention are directed to methods of forming earth-boring tools. Forming an earth-boring tool, according to some embodiments, may comprise forming a bit body 310 comprising a face 320 at a leading end thereof and a shank at a trailing end thereof. The bit body 310 may be formed from a metal or metal alloy, such as steel, or a particle-matrix composite material. In embodiments where the bit body 310 is formed of a particle-matrix composite material, the bit body 310 may be formed by conventional infiltration methods (in which hard particles (e.g., tungsten carbide) are infiltrated by a molten liquid metal matrix material (e.g., a copper-based alloy) within a refractory mold), as well as by newer methods generally involving pressing a powder mixture to form a green powder compact, and sintering the green powder compact to form a bit body 310. The green powder compact may be machined as necessary or desired, prior to sintering using conventional machining techniques like those used to form steel bodies or steel plate structures. Indeed, in some embodiments, features (e.g., cutting element pockets, etc.) may be formed with the bit body 310 in a green powder compact state, or in a partially sintered brown body state. Furthermore, additional machining processes may be performed after sintering the green powder compact to the partially sintered brown state, or after sintering the green powder compact to a desired final density.

The face 320 may be formed to comprise a cone region 150, a nose region 160, and shoulder region 170. The cone region 150 is located proximate a longitudinal axis 350 of the bit body 310 and extends radially outward therefrom. The nose region 160 comprises a region located radially outward from and adjacent to the cone region 150. Similarly, the shoulder region 170 comprises a region located radially outward from and adjacent to the nose region 160. The face 320 may be formed comprising at least one primary blade 330 extending radially outward over the face 320 and including a plurality of cutting elements 140', 140" disposed thereon extending from a location in the cone region 150 to a location in the shoulder region 170.

The face 320 may also include at least one secondary blade 340 also extending radially outward over a portion thereof. The at least one secondary blade 340 may be positioned to extend at least substantially over an area of the face 320 comprising the greatest work rate per cutting element. A plurality of cutting elements 140', 140" are also disposed on the at least one secondary blade 340 over at least a portion of the area of the face 320 comprising the greatest work rate per cutting element. The area of greatest work rate per cutting element may comprise any of the areas described above with reference to FIGS. 3 and 4. By way of example and not limitation, in at least some embodiments, the area of greatest work rate per cutting element may comprise at least a portion of at least one of the cone region 150 and the nose region 160.

Further embodiments of the present invention are directed to methods of designing an earth-boring tool. An earth-boring tool may be designed, according to some embodiments of the present invention, by providing a body of an earth-boring tool comprising at least one primary blade 330 extending radially outward over the face 320. The body of the earth-boring tool may be provided as a computer generated model, generated using a conventional Computer Aided Drafting (CAD) program, or the body of the earth-boring tool may be provided as a physical model, either full-scale or reduced scale. In some embodiments, a physical model may comprise a body of a previously run drill bit having an identical or similar body design.

An area of greatest work rate per cutting element is determined for the bit body 310. For an algorithmic or computer generated model of the bit body, the area of greatest work rate per cutting element may, in some embodiments, be determined by computational methods known to those of ordinary skill in the art. By way of example and not limitation, an algorithmic (e.g., computer based) model may be developed using some form of the PDCWEAR computer code or other suitable algorithm or set of algorithms, embodied in a computer program or otherwise. A non-limiting example of a PDCWEAR program that may be used is disclosed in D. A. Glowka, "Use of Single-Cutter Data in the Analysis of PDC Bit Designs: Part 2 Development and Use of the PDCWEAR Computer Code," *J. Petroleum Tech.,* 850, SPE Paper No. 19309 (August 1989), the disclosure of which is hereby incorporated herein, in its entirety, by this reference. The model may include a work-force model, a sliding-wear model, or any other model or combination of models useful for determining the wear or work of one or more individual cutting elements during drilling. The model may account for the location of one or more individual cutting elements, hydraulics, or other parameters of interest. For a physical model, physical testing may be performed, such as drilling, to determine the area of greatest work rate per cutting element. A non-limiting example of suitable methods that may be employed for evaluating existing drill bits and drill bit designs is disclosed in U.S. Patent Application Pub. No. 2007/0106487, the entire disclosure of which is hereby incorporated herein by this reference.

Upon determining the area of greatest work rate per cutting element of the bit body 310, the face 320 of the bit body 310 may be designed to include at least one secondary blade 340 positioned to extend over the face 320 at least substantially over the area of greatest work rate per cutting element. The at least one secondary blade 340 may be designed to extend over a portion of the area of greatest work rate or over the entire area of greatest work rate. The at least one secondary blade 340 may also be designed to be contained completely within the area of greatest work rate, or it may be designed to extend beyond the area of greatest work rate. A position for a plurality of cutting elements may be selected on the at least one secondary blade 340. The position for each cutting element of the plurality of cutting elements may be substantially in the area of greatest work rate per cutting element.

While certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. Thus, the scope of the invention is only limited by the literal language, and legal equivalents, of the claims which follow.

What is claimed is:

1. An earth-boring tool, comprising:

a body comprising a face at a leading end thereof and a shank at an opposing trailing end thereof;

at least one primary blade extending radially outward over the face and comprising cutting elements disposed thereon; and at least one secondary blade extending radially outward over a portion of the face and having cutting elements disposed thereon only within a region in which a greatest work rate per cutting element on the body is located, wherein the region of greatest work rate per cutting element on each secondary blade is located only within one of a cone region and a nose region of the face of the body.

2. The earth-boring tool of claim 1, wherein the at least one secondary blade comprises a plurality of secondary blades extending radially outward over a portion of the face.

3. The earth-boring tool of claim 2, wherein:

at least one secondary blade of the plurality of secondary blades comprises at least one cutting element disposed thereon at a first location within the region in which the greatest work rate per cutting element on the body is located; and at least one other secondary blade of the plurality of secondary blades comprises at least one cutting element disposed thereon at a second, different location within the region in which the greatest work rate per cutting element on the body is located.

4. An earth-boring tool, comprising:

a body comprising a face at a leading end thereof, the face comprising a cone region located proximate a longitudinal axis of the body, a nose region located radially outward from and adjacent to the cone region, and a shoulder region located radially outward from and adjacent to the nose region;

at least one primary blade extending radially from the cone region to the shoulder region; and at least one secondary blade extending radially from at least the cone region to the nose region and having cutting elements disposed thereon only within the cone region.

5. The earth-boring tool of claim 4, wherein the at least one secondary blade extends only within the cone region.

6. The earth-boring tool of claim 4, wherein the at least one secondary blade extends from the cone region into the nose region proximate a radially inner portion of the shoulder region.

7. The earth-boring tool of claim 4, wherein the at least one primary blade comprises a plurality of primary blades extending radially from the cone region to the shoulder region.

8. The earth-boring tool of claim 4, wherein the at least one secondary blade comprises a plurality of secondary blades extending radially from at least one of the cone region and the shoulder region to the nose region.

9. The earth-boring tool of claim 8, further comprising:

at least one other secondary blade of the plurality of secondary blades comprising cutting elements disposed only within the nose region.

10. The earth-boring tool of claim 4, wherein the body comprises a material selected from the group of materials consisting of a metal, a metal alloy, and a particle-matrix composite.

11. A method of forming an earth-boring tool, comprising:

forming a body comprising a face at a leading end thereof and a shank at a trailing end thereof;

forming at least one primary blade extending radially outward over the face and comprising cutting elements disposed thereon; and forming at least one secondary blade extending radially outward over a portion of the face and having cutting elements disposed thereon only within a region in which a greatest work rate per cutting element on the body is located, wherein the region of greatest work rate per cutting element on each secondary blade is located only within one of a cone region and a nose region of the face of the body.

12. The method of claim 11, wherein forming the body comprises forming a body of a material selected from the group of materials consisting of a metal, a metal alloy, and a particle-matrix composite.

13. The method of claim 12, wherein forming the body of a material comprising a particle-matrix composite material comprises:

providing a powder mixture;

pressing the powder mixture to form a green bit body; and at least partially sintering the green bit body.

14. A method of designing an earth-boring tool, comprising:

providing a body comprising at least one primary blade extending radially outward over a face thereof;

determining a location of a region of greatest work rate per cutting element on the body to be located only within one of a cone region and a nose region of the face of the body;

designing at least one secondary blade positioned on the face and extending only within the region of greatest work rate per cutting element; and selecting a position for cutting elements on each secondary blade, the position for each cutting element being located only within the region of greatest work rate per cutting element.

15. The method of claim 14, wherein providing the body comprising the at least one primary blade extending radially outward over the face thereof comprises providing the body as a computer generated model or a physical model.

16. The method of claim 14, wherein determining the location of the region of greatest work rate per cutting element on the body comprises employing a computational analysis.

17. The method of claim 14, wherein determining the location of the region of greatest work rate per cutting element on the body comprises physically testing the body.

* * * * *